US008434451B2

(12) United States Patent
Yoon et al.

(10) Patent No.: US 8,434,451 B2
(45) Date of Patent: May 7, 2013

(54) ENGINE BRAKE UNIT HAVING COMBINED OIL PASSAGE

(75) Inventors: Seock Joong Yoon, Seoul (KR); Kyung Mo Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 426 days.

(21) Appl. No.: 12/773,519

(22) Filed: May 4, 2010

(65) Prior Publication Data

US 2011/0073068 A1 Mar. 31, 2011

(30) Foreign Application Priority Data

Sep. 25, 2009 (KR) ..... 10-2009-0091084

(51) Int. Cl.
*F02D 13/04* (2006.01)
*F02D 13/02* (2006.01)

(52) U.S. Cl.
USPC ..... 123/321; 123/90.44

(58) Field of Classification Search ..... 123/321, 123/320, 90.12, 90.13, 90.33, 90.16, 90.44
See application file for complete search history.

(56) References Cited

U.S. PATENT DOCUMENTS

| | | | | |
|---|---|---|---|---|
| 5,477,824 | A | 12/1995 | Reedy | |
| 5,564,385 | A * | 10/1996 | Hakansson | 123/321 |
| 5,586,532 | A | 12/1996 | Faletti et al. | |
| 5,957,097 | A | 9/1999 | Schanz | |
| 5,975,251 | A | 11/1999 | McCarthy | |
| 6,244,257 | B1 | 6/2001 | Hu | |
| 6,253,730 | B1 | 7/2001 | Gustafson | |
| 6,257,201 | B1 * | 7/2001 | Kajiura et al. | 123/321 |
| 6,314,926 | B1 | 11/2001 | Meneely et al. | |
| 6,334,429 | B1 | 1/2002 | Little, Jr. | |
| 6,354,254 | B1 | 3/2002 | Usko | |
| 6,386,160 | B1 | 5/2002 | Meneely et al. | |
| 6,394,050 | B1 | 5/2002 | McCarthy et al. | |
| 6,394,067 | B1 | 5/2002 | Usko et al. | |
| 6,405,707 | B1 | 6/2002 | Feucht | |
| 6,422,186 | B1 | 7/2002 | Vanderpoel | |
| 6,594,996 | B2 | 7/2003 | Yang | |
| 6,691,674 | B2 | 2/2004 | McCarthy et al. | |
| 7,140,333 | B2 | 11/2006 | Persson et al. | |

(Continued)

FOREIGN PATENT DOCUMENTS

| | | | |
|---|---|---|---|
| JP | 57-105510 | A | 7/1982 |
| JP | 6-10640 | A | 1/1994 |

(Continued)

*Primary Examiner* — Mahmoud Gimie
(74) *Attorney, Agent, or Firm* — Morgan, Lewis & Bockius LLP

(57) ABSTRACT

An engine brake unit, may include a rocker shaft having an oil passage to open or close an exhaust valve when an engine braking is in operation, an exhaust rocker arm rotatable about the rocker shaft inserted into the exhaust rocker arm, wherein the exhaust rocker arm includes a supply oil passage communicating with the oil passage and the outside, and a recess connected to the supply oil passage and having an open lower portion, an actuator disposed in the recess of the exhaust rocker arm, wherein the actuator includes a piston that selectively moves downwards through the open lower portion of the recess by oil supplied from the supply oil passage to press the exhaust rocker arm while oil pressure in the oil passage has a predetermined pressure or more, and an oil control valve connected to the oil passage of the rocker shaft and controlling the oil pressure.

10 Claims, 10 Drawing Sheets

U.S. PATENT DOCUMENTS

| | | | | |
|---|---|---|---|---|
| 7,392,772 | B2 | 7/2008 | Janak et al. | |
| 7,520,262 | B2 | 4/2009 | Jeong et al. | |
| 7,673,600 | B2 | 3/2010 | Yang | |
| 7,984,705 | B2 | 7/2011 | Yang | |
| 8,065,987 | B2 | 11/2011 | Yang | |
| 8,210,144 | B2 | 7/2012 | Langewisch | |
| 8,240,278 | B2 | 8/2012 | Jeon et al. | |
| 2003/0024501 | A1 | 2/2003 | McCarthy et al. | |
| 2005/0274341 | A1 | 12/2005 | Usko et al. | |
| 2006/0081213 | A1 | 4/2006 | Yang et al. | |
| 2007/0144472 | A1* | 6/2007 | Yang | 123/90.16 |
| 2007/0175441 | A1 | 8/2007 | Jeong et al. | |
| 2007/0193543 | A1 | 8/2007 | Best | |
| 2009/0139486 | A1 | 6/2009 | Wagner | |
| 2010/0037854 | A1* | 2/2010 | Yang | 123/321 |
| 2010/0307451 | A1 | 12/2010 | Lee et al. | |
| 2010/0319657 | A1 | 12/2010 | Dodi et al. | |
| 2011/0023821 | A1 | 2/2011 | Yoon et al. | |
| 2011/0073068 | A1 | 3/2011 | Yoon et al. | |
| 2011/0114060 | A1 | 5/2011 | Jeon et al. | |
| 2011/0132298 | A1 | 6/2011 | Ruggiero et al. | |
| 2011/0220061 | A1 | 9/2011 | Wiley et al. | |

FOREIGN PATENT DOCUMENTS

| | | | |
|---|---|---|---|
| JP | 9-177635 | A | 7/1997 |
| JP | 2001-263017 | A | 9/2001 |
| JP | 2002-510008 | A | 4/2002 |
| KR | 2003-0062676 | A | 7/2003 |
| KR | 10-2007-0012536 | A | 1/2007 |
| KR | 10-0732445 | B1 | 6/2007 |
| KR | 10-2010-0064783 | A | 6/2010 |
| WO | WO 99/50108 | | 10/1999 |

* cited by examiner

ENGINE BRAKE UNIT HAVING COMBINED OIL PASSAGE

CROSS REFERENCE TO RELATED APPLICATION

The present application claims priority to Korean Patent Application Number 10-2009-0091084 filed on Sep. 25, 2009, the entire contents of which application is incorporated herein for all purposes by this reference.

BACKGROUND OF THE INVENTION

1. Field of the Invention

The present invention relates to an engine brake unit having a combined oil passage, more particularly, to an engine brake unit having a combined oil passage, in which a single oil passage structure is produced by combining an engine brake oil passage and a lubricating oil passage together in such a manner that an engine brake can be operated by the single oil passage structure.

2. Description of Related Art

Engine braking generally refers to the act of slowing down a vehicle by down-shifting to a lower transmission gear. In engine braking, however, an excessive amount of load is applied to respective parts of an engine when a transmission is down-shifted. This may cause drawbacks such as reduced engine lifetime.

Accordingly, a conventional engine brake was devised, which can improve the effect of engine braking by opening an exhaust port of a cylinder at the end of compression stroke so that power stroke does not occur or by maintaining the exhaust port to be partially open so that compression stroke does not occur.

Below, a description will be given of a conventional engine brake with reference to the accompanying drawings.

FIG. 1A is a perspective view illustrating part of a conventional engine brake unit.

The conventional engine brake unit is a compression release engine brake, which opens an exhaust port 30 at the end of compression stroke so that power stroke does not occur. In the conventional engine brake unit, an actuator 40 located inside a valve bridge 35 serves to press the exhaust valve 30 by hydraulic pressure generated by brake oil.

At this time, a brake oil passage 11 supplying brake oil for operating the actuator 40 and a lubricating oil passage 12 for supplying oil to prevent engine parts from being damaged by lessening friction, are separately formed in a rocker shaft 10 and a rocker arm 20.

Such a conventional art has a complicated construction of oil passages since the lubricating oil passage and the brake oil passage are separately formed in the rocker shaft and the rocker arm. The problem of the conventional art is inefficiency.

FIG. 1B is a perspective view illustrating part of another conventional engine brake unit.

The engine brake unit of another conventional art is a full-cycle engine brake, which maintains an exhaust valve 30 to be opened so that compression stroke does not occur. Such an engine brake has a separate housing 50, inside of which an actuator 40 is installed so that the exhaust valve 30 can maintain a pressurized state due to oil pressure generated by brake oil.

Brake oil is fed to respective parts and a solenoid valve 60 through one passage formed in a rocker shaft 10. Brake oil is supplied from the solenoid valve 60 to the housing 50.

However, such a conventional engine brake unit has problems such as an increase in weight and production cost due to an increase in the number of parts since the housing, inside of which the actuator of the engine brake is stored, is additionally provided.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine brake unit having a combined oil passage, which can reduce weight and manufacturing cost due to a simplified configuration having combined oil passages and an actuator integrally provided inside an exhaust rocker arm.

In an aspect of the present invention, the engine brake unit, may include a rocker shaft having, therein, an oil passage through which oil flows to lubricate engine parts and to open or close an exhaust valve when an engine braking is in operation, an exhaust rocker arm rotatable about the rocker shaft inserted into the exhaust rocker arm, wherein the exhaust rocker arm includes, therein, a supply oil passage communicating with the oil passage and the outside, and a recess connected to the supply oil passage and having an open lower portion, an actuator disposed in the recess of the exhaust rocker arm, wherein the actuator includes a piston that selectively moves downwards through the open lower portion of the recess by oil supplied from the supply oil passage to press the exhaust rocker arm while oil pressure in the oil passage has a predetermined pressure or more, and an oil control valve connected to the oil passage of the rocker shaft and controlling the oil pressure.

The oil control valve may supply oil into the oil passage of the rocker shaft to control the oil pressure to be equal to or greater than the predetermined pressure when the engine braking is in operation, and to control the oil pressure to be below the predetermined pressure when the engine braking is not in operation.

The actuator may further include a control screw defining a hydraulic oil passage therein and having a through-hole connecting the hydraulic oil passage to the supply oil passage, a check valve received in the hydraulic oil passage of the control screw, wherein the check valve includes a check ball that selectively opens an entrance of the hydraulic oil passage according to the oil pressure, and a control valve received in an storage hole formed in an inner upper portion of the control screw and including a control piston, the control piston slidably received in the storage hole and selectively pressing the check ball according to the oil pressure so that the check ball closes or opens the entrance of the hydraulic oil passage, wherein the piston of the actuator is slidably disposed in the recess of the exhaust rocker arm, and a storage recess slidably receiving a lower portion of the control screw is formed inside the piston of the actuator, the piston of the actuator being displaced downwards from the control screw by oil supplied through the hydraulic oil passage to press the exhaust valve when the oil pressure is equal to or higher than the predetermined pressure.

The check valve may include an elastic member disposed in the hydraulic oil passage and applying an elastic force to the check ball in a direction of closing the entrance of the hydraulic oil passage, and a hollow retainer fixed to a lower end portion of the hydraulic oil passage in the control screw, to support the elastic member and selectively provide oil to the piston therethrough.

The control valve may include a control elastic member disposed in the storage hole to apply an elastic force to move the control piston in a direction of opening or closing the through-hole according to the oil pressure, wherein the control piston has a protrusion extending from an underside thereof to come into contact with the check ball through the through-hole, so that the check ball is selectively pressed by the control piston in a direction of opening or closing the hydraulic oil passage according to the oil pressure, and wherein, while the engine braking is in operation, an operating pressure of the control elastic member is less than the predetermined pressure so that the control elastic member is compressed.

The control valve may further include a fixing nut fixedly coupled to an upper portion of the storage hole of the control screw, thereby supporting the control elastic member to press the control piston downwards.

The diameter of the protrusion may be smaller than the diameter of the through-hole with a predetermined gap therebetween.

The control piston may have an inclined surface on a lower portion thereof, the cross section of which narrows toward the protrusion, wherein the length of the control elastic member is set in such a manner that the control elastic member opens part of the through-hole when the control elastic member is free.

The control screw may be thread-engaged with the storage hole of the exhaust rocker arm and has a flange on an outer circumference of a lower end thereof, the flange radially protruding to butt against an inner circumference of the storage recess of the piston of the actuator, and wherein the actuator further includes, a snap ring fixedly coupled to an upper portion of the storage recess of the piston of the actuator, and a return elastic member located between the snap ring and the flange of the control screw and applying an elastic force in a direction of raising the piston of the actuator.

The actuator may further include a displacement control ring fixed to the middle portion of the storage recess between the snap ring and a bottom portion of the storage recess to limit the displacement of the piston.

The recess may be provided in a middle portion of the supply oil passage and selectively receives the oil from the supply oil passage and the actuator presses one portion of a valve bridge connecting two plugs of the exhaust valve together so that one of the plugs is moved downward when the engine brake is in operation.

According to exemplary embodiments of the present invention as set forth above, the oil passage structure is simplified since the oil passages are combined with each other, the rocker shaft and the exhaust rocker arm can be easily manufactured. Furthermore, weight and manufacturing cost can be reduced since the actuator is integrally provided inside the rocker arm.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1A:
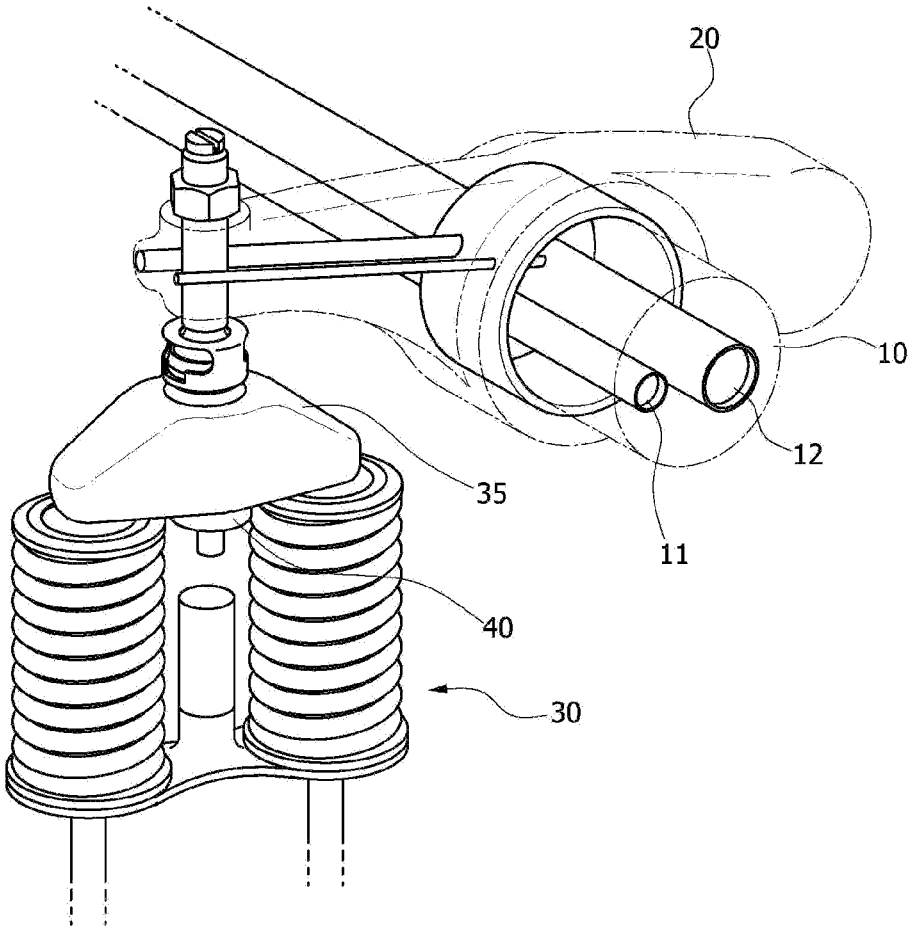
FIG. 1a (Prior art)
FIG. 1A is a perspective view illustrating part of a conventional engine brake unit.
Figure 1B:
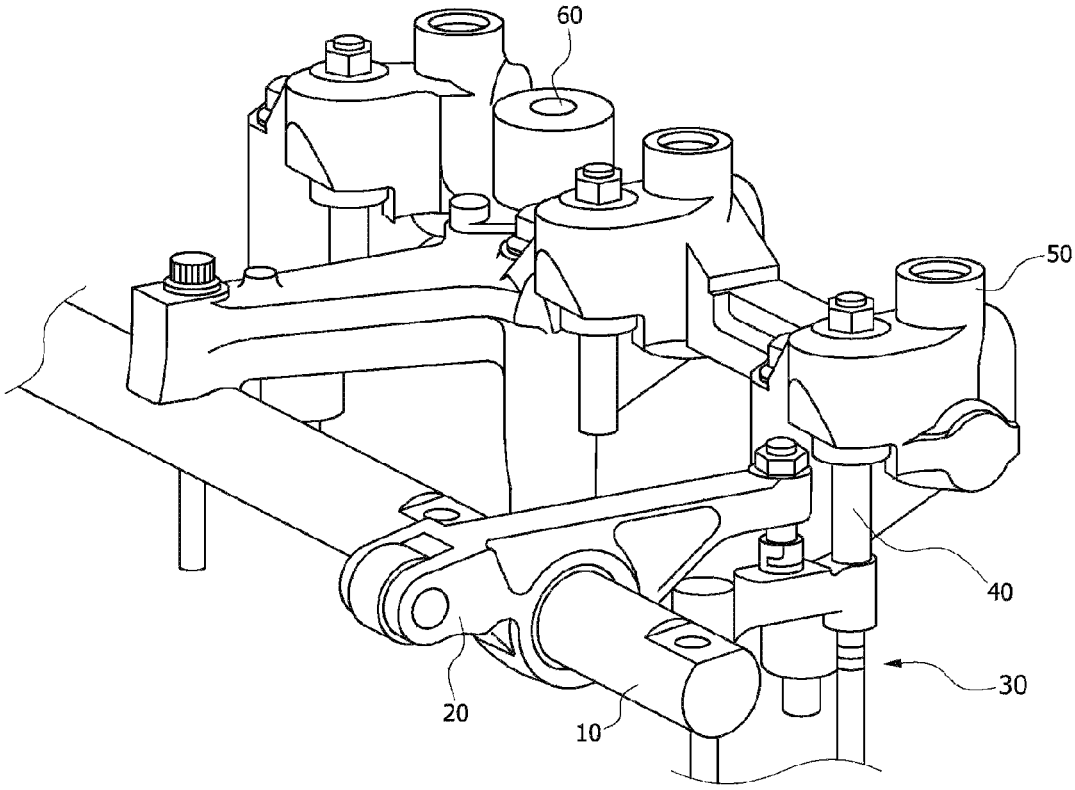
FIG. 1b (Prior art)
FIG. 1B is a perspective view illustrating part of another conventional engine brake unit.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
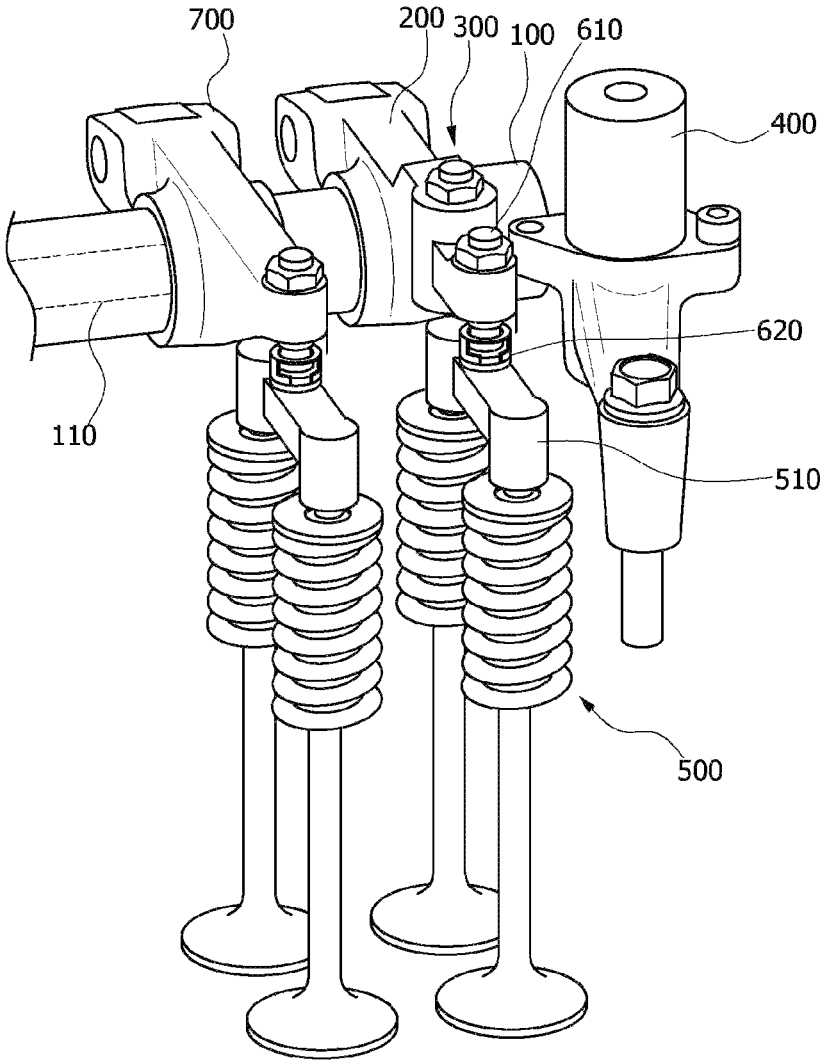
FIG. 2 is a perspective view illustrating an exemplary engine brake unit having a combined oil passage in accordance with the present invention.
Figure 3A:
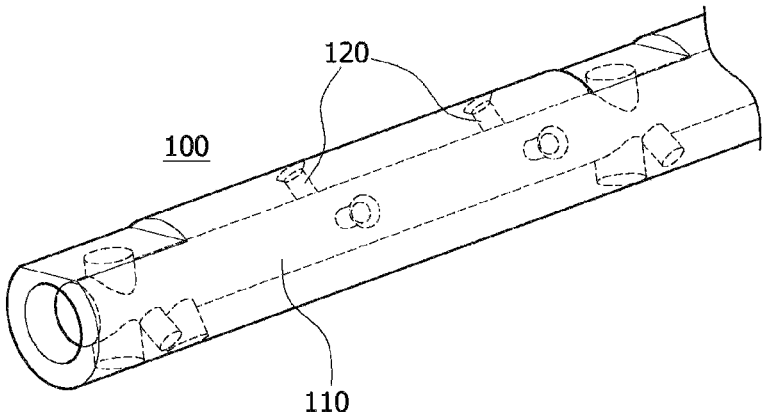
FIGS. 3A and 3B are perspective views each illustrating important parts of the exemplary engine brake unit having a combined oil passage shown in FIG. 2.
Figure 3B:
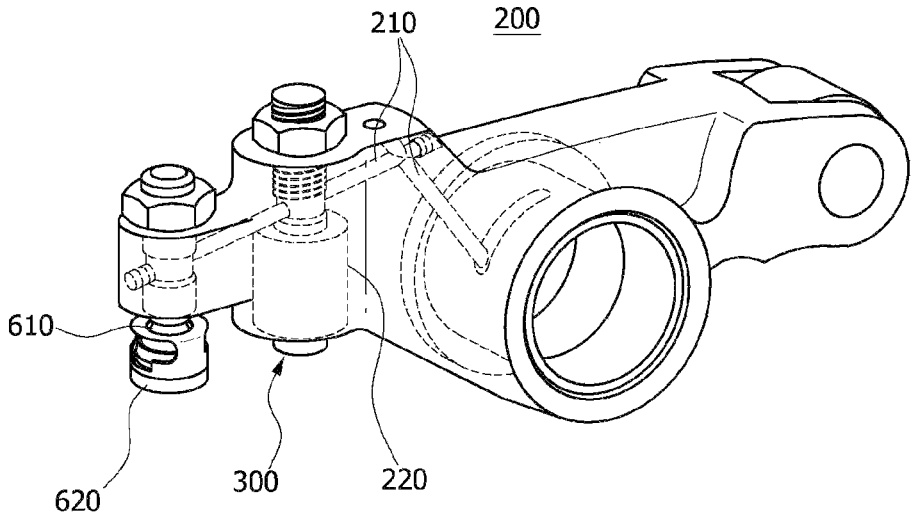

FIG. 2 is a perspective view illustrating an engine brake unit having a combined oil passage in accordance with an exemplary embodiment of the present invention, and FIGS. 3A and 3B are perspective views each illustrating important parts of the engine brake unit having a combined oil passage shown in FIG. 2.

The engine brake unit having a combined oil passage in accordance with an exemplary embodiment of the present invention is realized by combining a brake oil passage and a lubricating oil passage, formed in a rocker shaft 100 and an exhaust rocker arm 200, in order to simplify an oil passage structure through which oil flows. The engine brake unit is characterized by controlling the pressure of oil so that oil is continuously supplied through a single passage to lubricate parts and generates a certain amount of hydraulic pressure to operate an actuator 300 that presses an exhaust valve 500 when the engine brake is actuated.

In order to enable the above operation, the engine brake unit having a combined oil passage in accordance with an exemplary embodiment of the present invention includes a rocker shaft 100, an exhaust rocker arm 200, an actuator 300, and an oil control valve 400.

The rocker shaft 100 defines therein an oil passage 110, along which oil can flow. The rocker shaft 100 is fitted into the exhaust rocker arm 200. The exhaust rocker arm 200 defines, therein, a supply oil passage 210 communicating with the oil passage 110 of the rocker shaft 100 and a recess 220 connected with the supply oil passage 210. The actuator 300 is mounted on the recess 220 of the exhaust rocker arm 200, and is operated so that the exhaust valve 500 is pressed when the pressure of oil supplied to the supply oil passage 210 is the same as or greater than a preset pressure. The oil control valve 400 controls the pressure of oil supplied to the supply oil passage 210 through the oil passage 110.

The oil passage 110, defined inside the rocker shaft 100, extends along the axial direction of the rocker shaft 100. The oil passage 110 is connected to the supply oil passage 210 formed in the exhaust rocker arm 200, into which the rocker shaft 100 is fitted.

Auxiliary passages 120 crossing the oil passage 110 are also formed, by which the oil passage 110 are connected to the supply oil passage 210. The auxiliary passages 120 can preferably be provided by the number of exhaust rocker arms 200 and the intake rocker arms 700.

The exhaust rocker arm 200 performs angular motion about the rocker shaft 100 to press the exhaust valve 500. In the exhaust rocker arm 200, the recess 220 is connected to the middle portion of the supply oil passage 210. One end of the supply oil passage 210 is fixedly coupled with a control screw 610 that controls the interval between the exhaust rocker arm 200 and the exhaust valve 500. The control screw 610 also defines, therein, a lubricating oil passage connected to the supply oil passage 210.

The exhaust valve 500 also includes a valve bridge 510 at the top end, which connects two plugs of the exhaust valve 500. A socket 620 is provided on one end of the control screw 610. The control screw 610 is located in a position from which it is able to press the central portion of the valve bridge 510. With this configuration, when the exhaust rocker arm 200 performs angular motion, the socket 620 presses the valve bridge 510 so that the two plugs of the exhaust valve 500 descend, thereby opening an exhaust port of a cylinder.

The recess 220 of exhaust rocker arm 200 is located above one end portion of the valve bridge 510 so that the actuator 300 received in the recess 220, as will be described later, can press one end portion of the valve bridge 510, thereby pressing only one plug of the exhaust valve 500.

In this case, the actuator 300 is operated when the pressure of oil flowing along the supply oil passage 210 is a preset value or more. The oil control valve 400 serves to control the pressure of oil supplied to the supply oil passage 210. The oil control valve 400 controls oil to be supplied to the oil passage 110 of the rocker shaft 100 with a pressure set the same as or greater than the preset pressure when the engine brake is actuated. When the engine brake is not actuated, the oil control valve 400 controls oil to be supplied to the oil passage 110 with a pressure below the preset value.

Here, the lubricating oil passage can be configured so that oil can be supplied to the lubricating oil passage irrespective of oil pressure, thereby reducing friction between the valve bridge 510 and the socket 620.

Figure 4A:
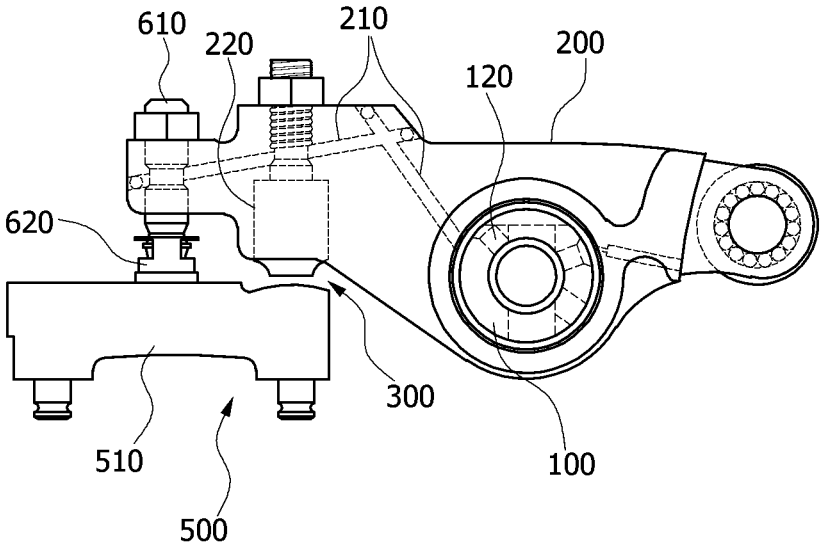
FIGS. 4A and 4B are front elevation views each illustrating important parts of the exemplary engine brake unit having a combined oil passage shown in FIG. 2.
Figure 4B:
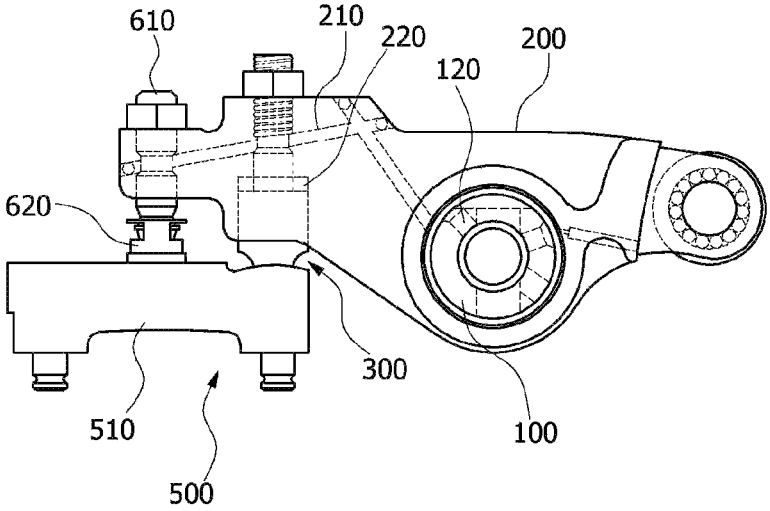

FIGS. 4A and 4B are front elevation views each illustrating important parts of the engine brake unit having a combined oil passage shown in FIG. 2.

When the driver actuates the engine brake, the engine brake unit having a combined oil passage in accordance with an exemplary embodiment of the present invention supplies oil to the oil passage by controlling the pressure of oil to be the maximum of a preset range using the oil control valve. When the actuation of the engine brake is stopped, the engine brake unit supplies oil by controlling the pressure of oil to be the minimum of the preset range.

When the engine brake is not actuated, oil having the minimum pressure of the preset range is supplied to the oil passage 110, from which oil flows through the auxiliary passage 120 to the supply oil passage 210. From the supply oil passage 210, oil flows to the lubricating oil passage of the control screw 610 without operating the actuator 300, and is then discharged from the exhaust rocker arm 200.

When the engine brake is actuated, oil having a pressure the same as or greater than the preset pressure is supplied to the supply oil passage 210, thereby forming oil pressure inside the recess 220 to operate the actuator 300. Thereby, a piston, which will be described later, presses one end portion of the valve bridge 510 so that one plug of the exhaust valve 500 descends.

Due to the actuator 300, which is operated only if oil having a preset pressure or more is supplied, the oil passage along which lubricating oil flows and the oil passage along which oil for operating the actuator 300 flows are combined together. This, as a result, simplifies the manufacturing process of the rocker shaft 100 and the exhaust rocker arm 200, thereby improving productivity and reducing manufacturing costs.

Figure 5:
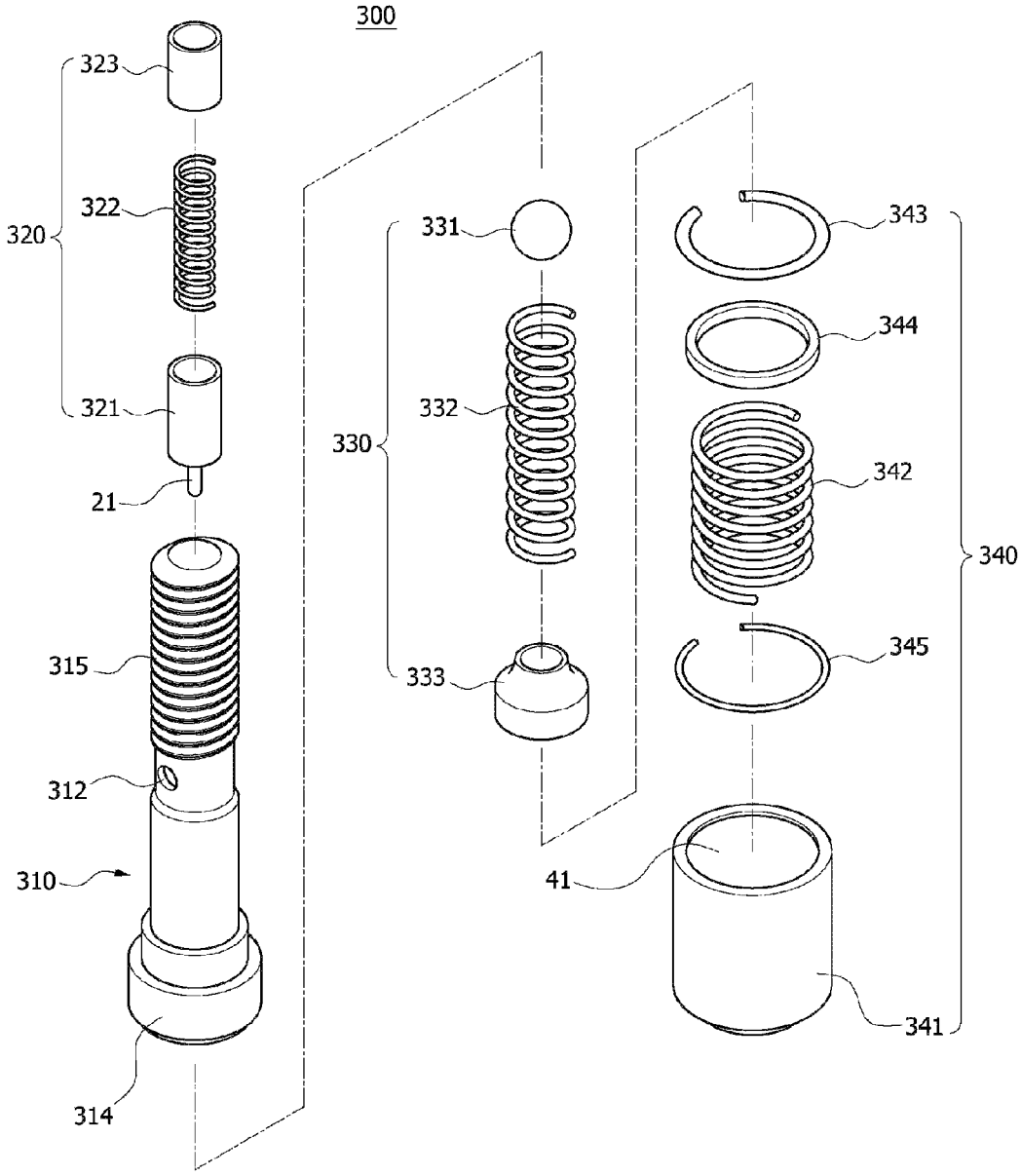
FIG. 5 is an exploded perspective view of the actuator of the exemplary engine brake unit having a combined oil passage shown in FIG. 2.

FIG. 5 is an exploded perspective view of the actuator 300 of the engine brake unit shown in FIG. 2, and FIGS. 6A to 6D are cross-sectional views each illustrating an operating state of the actuator 30 of the engine brake unit shown in FIG. 2.

The actuator 300 in accordance with an exemplary embodiment of the present invention includes a control screw 310, a pressing module 340, a control valve 320, and a check valve 330. The control screw 310 defines, therein, a hydraulic oil passage 311 connected to the supply oil passage 210. A through-hole 312 of the control screw 310 is located in line with the supply oil passage 210 when the control screw 310 is fixedly coupled with the exhaust rocker arm 200. The pressing module 340 includes a piston 341, inside of which a storage recess 41 is formed to receive the lower portion of the control screw 310. The piston 310 is displaced by oil, supplied through the hydraulic oil passage 311, to press the exhaust valve 500. The control valve 320 is received in the inner upper portion of the control screw 310 to open/close the through-hole 312 of the control valve 320. The check valve 330 is received in the inner lower portion of the control screw 310 to open/close the hydraulic oil passage 311.

The control screw 310 also has a threaded portion 315 on one end and a flange 314 on the outer circumference of the other end, together with the hydraulic oil passage 311 and the through hole 312 connecting the hydraulic oil passage 311 to the supply oil passage 210. The threaded portion 315 has threads to be thread-engaged into the recess 220 of the exhaust rocker arm 200. The flange 314 radially protrudes to butt against the inner circumference of the storage recess 41. The threaded portion 315 can also define, therein, a storage hole 317 for the control valve 320.

The control valve 320 includes a control piston 321, a control spring 322, and a fixing nut 323. The control piston 321 has a protrusion 21 on one end, and the outer circumference of the control piston 321 is configured to come into close contact with the inner circumference of the upper portion of the storage hole 317. The control spring 322 applies an elastic force to the control piston 321 in the direction of closing the through-hole 312. The fixing nut 323 is fixedly coupled to the upper end of the storage hole 317 to support the control spring 322.

The control spring 322 can preferably be implemented by a compression spring. When the engine brake is in operation, oil is supplied to the supply oil passage 210 under a pressure greater than a force, which compresses the control spring 322, so that the control spring 322 maintains the compressed state when the engine brake is in operation. In other words, the pressure of oil (preset pressure) supplied in operation of the engine brake is set the same as the force that compresses the control spring 322.

The control piston 321 has an inclined surface on the lower portion, the cross section of which narrows toward the protrusion 21 to form a predetermined angle between the included surface and the supply oil passage 210. The length of the control spring 322 is set in such a manner that the control piston 321 does not completely close the through-hole 312 when the control spring 322 is free. As a result, if the pressure of oil supplied to the supply oil passage 210 is below the preset pressure, the through-hole 312 is maintained open by the control spring 321.

The check valve 330 includes a check ball 331, a check spring 332, and a retainer 333. The check ball 331 serves to open and close the entrance of the hydraulic oil passage 311 while reciprocating in the longitudinal direction of the hydraulic oil passage 311. The check spring 332 applies an elastic force to the check ball 331 in the direction in which the check ball 331 closes the entrance of the hydraulic oil passage 311. The retainer 333 is fixedly coupled to the lower end of the control screw 310 to support the check spring 332.

The elastic force of the check spring 332 acts in the direction reverse to the direction that the elastic force of the control spring 332 acts. The elastic modulus of the check spring 332 is set smaller than that of the control spring 332. When the control spring 332 is free, the protrusion 21 of the control piston 321 presses the check ball 331 in the direction of opening the entrance 31 of the hydraulic oil passage 311 so that the entrance 31 of the hydraulic oil passage 311 can be opened. Accordingly, when oil is supplied at a pressure below the preset pressure to the supply oil passage 210, it flows into and from the hydraulic oil passage 311 by the through-hole 312.

In addition, the diameter of the entrance 31 of the hydraulic oil passage 311 is set smaller than that of the hydraulic oil passage 311 and the diameter of the check ball 331 is set greater than that of the entrance 31 of the hydraulic oil passage 311 but smaller than that of the hydraulic oil passage 311 so that the check ball 331 can open and close the entrance 31 of the hydraulic oil passage 311 without interfering with the inner circumference of the hydraulic oil passage 311.

The pressing module 340 includes the piston 341, a snap ring 343, and a return spring 342. The storage recess 41 of the piston 341 receives the lower portion of the control screw 310. The outer circumference of the piston 341 is in close contact with the inner circumference of the recess 220. The piston 341 is displaced along the axis of the recess 220 under the pressure of oil, supplied along the hydraulic oil passage 311, thereby pressing the exhaust valve 500. The snap ring 343 is fixedly coupled to the upper portion of the storage recess 41. The return spring 342 may be an extension spring and is located between the snap ring 343 and the flange 314 of the control screw 310 to apply an elastic force in order to raise the piston 341.

A support retainer 333 having an inner diameter smaller than that of the snap ring 343 can also be provided between the snap ring 343 and the return spring 342 so that the return spring 342 can be stably supported.

In addition, the pressing module 340 can also include a displacement control ring 345 fixed to the middle portion of the storage recess 41. If the piston 341 is displaced a predetermined distance or more, the flange 314 of the control screw 310 interferes with the displacement control ring 345 to limit the displacement of the piston 341. The displacement control ring 345 can prevent the piston 341 from excessively descending to the extent that the exhaust valve 500 may be damaged by contact with a piston inside the cylinder.

The operating states of the engine brake unit having the above-described configuration will now be described hereinafter with reference to FIGS. 6A to 6D.

When the engine brake is not in operation, oil is supplied into the oil passage 110 of the rocker shaft 100, at a pressure (i.e., 0.5 bar in this embodiment) below a preset pressure set by the oil control valve 400.

Figure 6A:
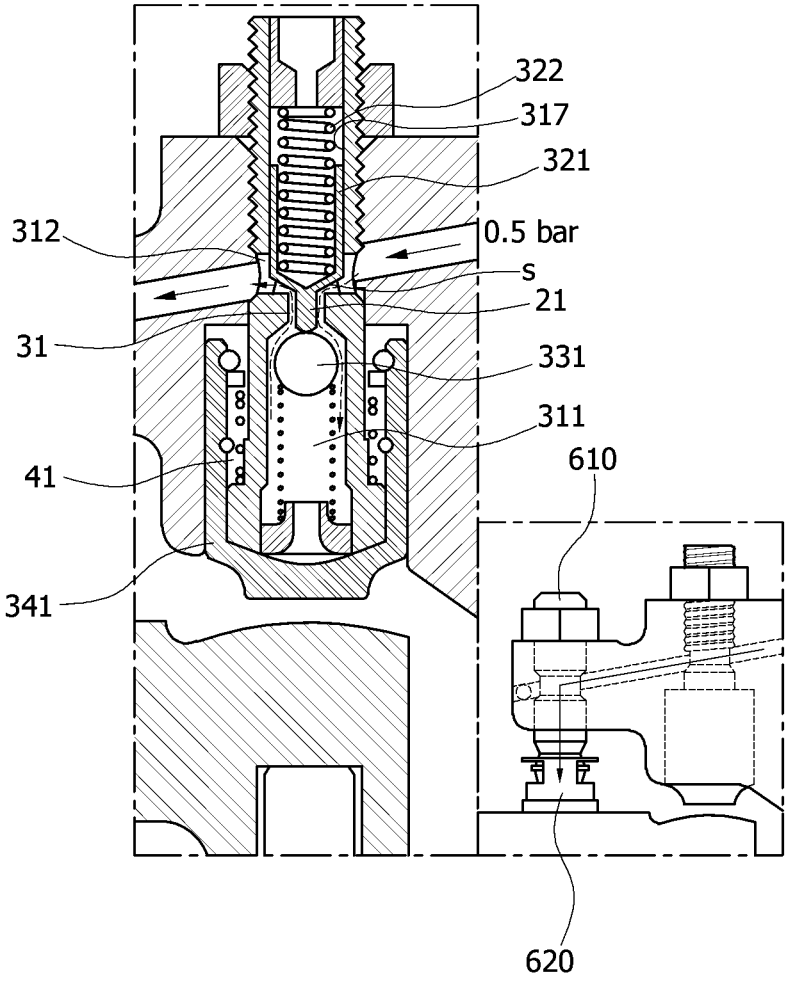
FIGS. 6A to 6D are cross-sectional views each illustrating an operating state of the actuator of the exemplary engine brake unit having a combined oil passage shown in FIG. 2.

First, if the pressure of oil, supplied into the supply oil passage 210 through the oil passage 110, is below the preset pressure, the control spring 322 is free and the through-hole 312 is open. The protrusion 21 of the control piston 321 presses the check spring 332 in the compressing direction (i.e., the direction in which the check spring 332 is compressed) so that the entrance 31 the hydraulic oil passage 311 is also open. (FIG. 6A)

In this state, oil supplied to the supply oil passage passes through the through-hole 312 and the hydraulic oil passage 311 of the control screw 310 and is then introduced into a lubricating circuit of the control screw 610. The piston 341 of the pressing module 340 is not operated so that the underside of the control screw 310 is not in contact with the bottom of the storage recess 41 of the piston 341.

When the engine brake is in operation, oil is supplied to the oil passage 110 of the rocker shaft 100. If the pressure of oil, supplied to the supply oil passage 210 through the oil passage 110, is the preset pressure or more, the control piston 321 is displaced by oil in the direction of compressing the control spring 322, thereby completely opening the through-hole 312.

The operating pressure (e.g., 1.5 bar in this embodiment), at which the control spring 322 begins to be compressed, is set the same as the preset pressure of oil so that the through-hole 312 can be completely opened when the preset pressure of oil is set the maximum. At the same time, the force of the protrusion 21 of the control piston 321 pressing the check ball 331 in the direction of opening the entrance 31 of the hydraulic oil passage 311 is removed.

Figure 6B:
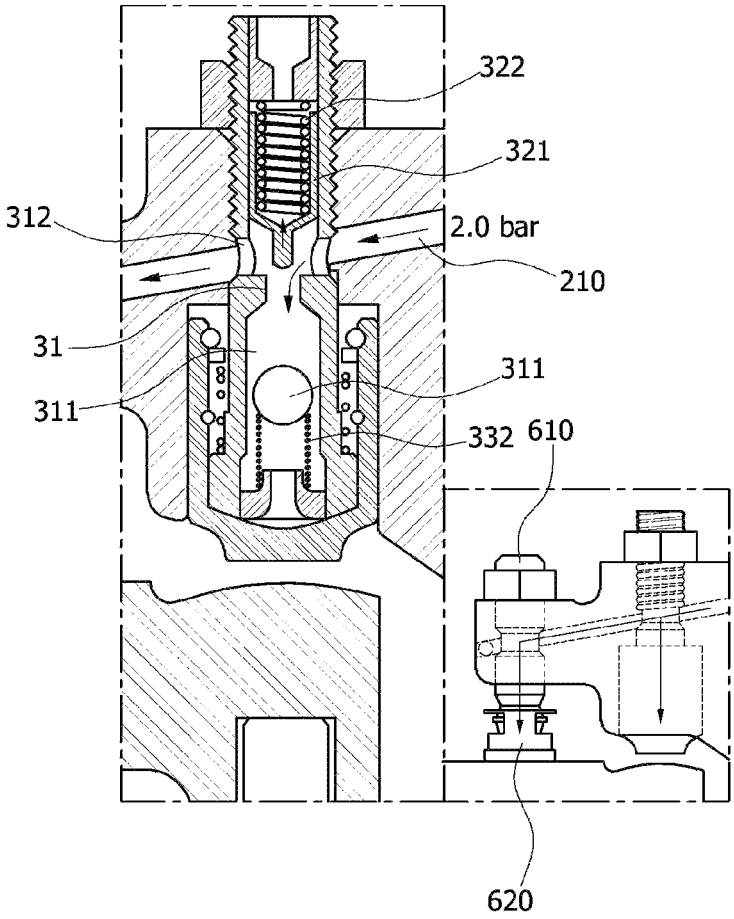

Although the check ball 331 is not subjected to an external force as described above, the check spring 332 is compressed due to the difference between the pressure created inside the hydraulic oil passage and the pressure of oil introduced into the hydraulic oil passage 311. Accordingly, the check ball 331 is displaced in the direction of opening the entrance 31 of the hydraulic oil passage 311, and the hydraulic oil passage 311 is then filled with oil. (FIG. 6B)

If an amount of oil greater than the volume inside the hydraulic oil passage 311 is introduced, the piston 341 is displaced downward, pressing the exhaust valve 500, while the space between the bottom of the storage recess 41 and the underside of the control screw 310 is also filled with oil.

Figure 6C:
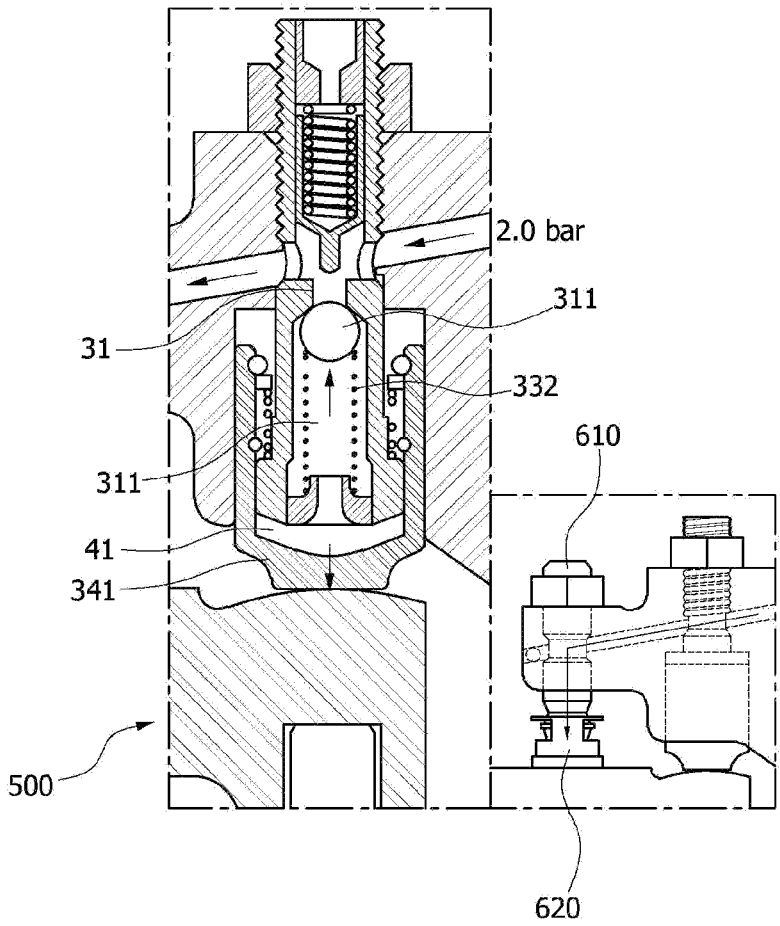

Then, the pressures of oil in the hydraulic oil passage 311, the supply oil passage 210, and the through-hole 312 become the same so that only the restoring force of the check spring 332 is applied to the check ball 331. This, as a result, raises the check ball 331, thereby closing the entrance 31 of the hydraulic oil passage 311. Accordingly, the pressures of oil inside the hydraulic oil passage 311 and the storage recess 41 of the piston 341 can be maintained constant, thereby pressing the exhaust valve 500 with a constant force so that the pressed state can be maintained. (FIG. 6C)

Figure 6D:
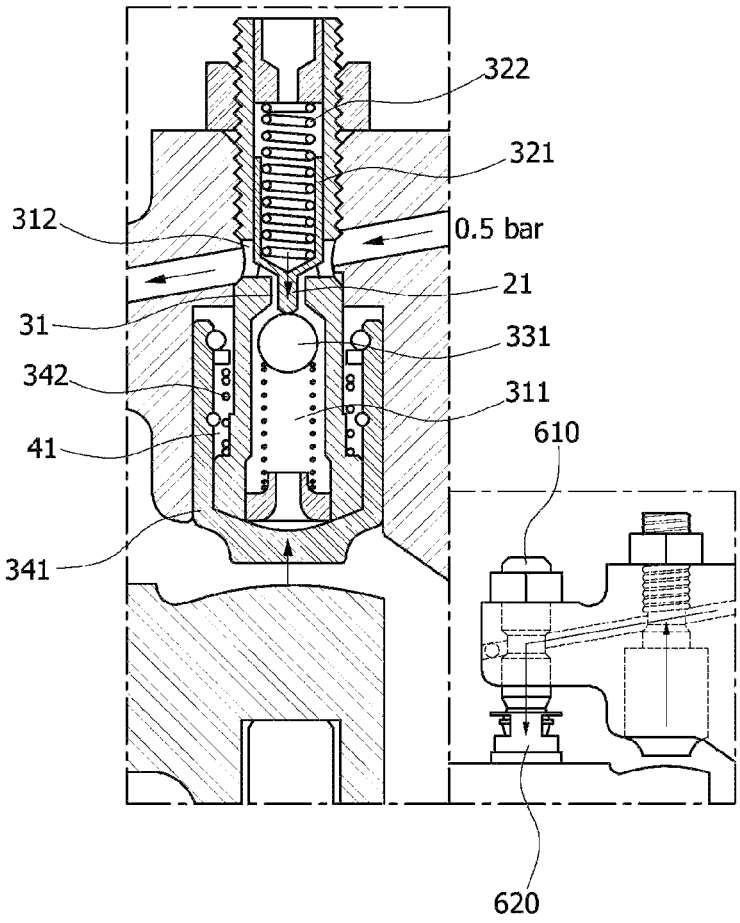

When the operation of the engine brake is stopped, the oil control valve 400 supplies oil again at a pressure below the preset pressure. When oil is supplied at a pressure below the preset pressure, the control piston 321 is displaced downward in the direction of closing the through-hole 312 in response to the control spring 322 returning to the original position. Then, the protrusion 21 of the control piston 321 presses the check ball 331 in the direction of opening the entrance 31 of the hydraulic oil passage 311 so that the entrance 31 of the hydraulic oil passage 311 can be opened. (FIG. 6D).

As a result, oil is discharged from the hydraulic oil passage 311 to the supply oil passage 210 through the entrance 31 of the hydraulic oil passage 311, so that the return spring 342 returns to the original position, thereby raising the piston 341.

As set forth above, the lubricating oil passage and the oil passage for generating the hydraulic pressure when the engine brake is in operation can be combined into one structure since the actuator is configured to operate at a specific pressure. In addition, since the actuator is provided inside the exhaust rocker arm, parts such as a housing to be separately provided outside the exhaust rocker arm are not necessary. Accordingly, weight and manufacturing costs can be advantageously reduced.

For convenience in explanation and accurate definition in the appended claims, the terms "upper", "lower", "inner", and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine brake unit, comprising:

a rocker shaft having, therein, an oil passage through which oil flows to lubricate engine parts and to open or close an exhaust valve when an engine braking is in operation;

an exhaust rocker arm rotatable about the rocker shaft inserted into the exhaust rocker arm, wherein the exhaust rocker arm includes, therein, a supply oil passage communicating with the oil passage and the outside, and a recess connected to the supply oil passage and having an open lower portion;

an actuator disposed in the recess of the exhaust rocker arm, wherein the actuator includes a piston that selectively moves downwards through the open lower portion of the recess by oil supplied from the supply oil passage to press the exhaust rocker arm while oil pressure in the oil passage has a predetermined pressure or more; and an oil control valve connected to the oil passage of the rocker shaft and controlling the oil pressure;

wherein the actuator further includes:

a control screw defining a hydraulic oil passage therein and having a through-hole connecting the hydraulic oil passage to the supply oil passage;

a check valve received in the hydraulic oil passage of the control screw, wherein the check valve includes a check ball that selectively opens an entrance of the hydraulic oil passage according to the oil pressure; and a control valve received in an storage hole formed in an inner upper portion of the control screw and including a control piston, the control piston slidably received in the storage hole and selectively pressing the check ball according to the oil pressure so that the check ball closes or opens the entrance of the hydraulic oil passage, wherein the piston of the actuator is slidably disposed in the recess of the exhaust rocker arm, and a storage recess slidably receiving a lower portion of the control screw is formed inside the piston of the actuator, the piston of the actuator being displaced downwards from the control screw by oil supplied through the hydraulic oil passage to press the exhaust valve when the oil pressure is equal to or higher than the predetermined pressure.

2. The engine brake unit in accordance with claim 1, wherein the oil control valve supplies oil into the oil passage of the rocker shaft to control the oil pressure to be equal to or greater than the predetermined pressure when the engine braking is in operation, and to control the oil pressure to be below the predetermined pressure when the engine braking is not in operation.

3. The engine brake unit in accordance with claim 1, wherein the check valve includes:

an elastic member disposed in the hydraulic oil passage and applying an elastic force to the check ball in a direction of closing the entrance of the hydraulic oil passage; and a hollow retainer fixed to a lower end portion of the hydraulic oil passage in the control screw, to support the elastic member and selectively provide oil to the piston therethrough.

4. The engine brake unit in accordance with claim 3, wherein the control valve includes a control elastic member disposed in the storage hole to apply an elastic force to move the control piston in a direction of opening or closing the through-hole according to the oil pressure, wherein the control piston has a protrusion extending from an underside thereof to come into contact with the check ball through the through-hole, so that the check ball is selectively pressed by the control piston in a direction of opening or closing the hydraulic oil passage according to the oil pressure, and wherein, while the engine braking is in operation, an operating pressure of the control elastic member is less than the predetermined pressure so that the control elastic member is compressed.

5. The engine brake unit in accordance with claim 4, wherein the control valve further includes a fixing nut fixedly coupled to an upper portion of the storage hole of the control screw, thereby supporting the control elastic member to press the control piston downwards.

6. The engine brake unit in accordance with claim 4, wherein the diameter of the protrusion is smaller than the diameter of the through-hole with a predetermined gap therebetween.

7. The engine brake unit in accordance with claim 4, wherein the control piston has an inclined surface on a lower portion thereof, the cross section of which narrows toward the protrusion, wherein the length of the control elastic member is set in such a manner that the control elastic member opens part of the through-hole when the control elastic member is free.

8. The engine brake unit in accordance with claim 7, wherein the control screw is thread-engaged with the storage hole of the exhaust rocker arm and has a flange on an outer circumference of a lower end thereof, the flange radially protruding to butt against an inner circumference of the storage recess of the piston of the actuator, and wherein the actuator further includes:

a snap ring fixedly coupled to an upper portion of the storage recess of the piston of the actuator; and a return elastic member located between the snap ring and the flange of the control screw and applying an elastic force in a direction of raising the piston of the actuator.

9. The engine brake unit in accordance with claim 8, wherein the actuator further includes a displacement control ring fixed to the middle portion of the storage recess between the snap ring and a bottom portion of the storage recess to limit the displacement of the piston.

10. The engine brake unit in accordance with claim 1, wherein the recess is provided in a middle portion of the supply oil passage and selectively receives the oil from the supply oil passage and the actuator presses one portion of a valve bridge connecting two plugs of the exhaust valve together so that one of the plugs is moved downward when the engine brake is in operation.

* * * * *